US006305202B1

(12) United States Patent
Kleber

(10) Patent No.: US 6,305,202 B1
(45) Date of Patent: Oct. 23, 2001

(54) ROTATABLE STUFFING DEVICE FOR SUPERPLASTIC FORMING AND METHOD

(75) Inventor: Richard Murray Kleber, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/820,599

(22) Filed: Mar. 30, 2001

(51) Int. Cl.[7] ..... B21D 26/02; B21D 9/10
(52) U.S. Cl. ..... 72/57; 72/212; 29/421.1
(58) Field of Search ..... 72/212, 57, 56; 29/421.1

(56) References Cited

U.S. PATENT DOCUMENTS 1,032,907 * 7/1912 Hyde ..... 72/57
2,317,869 * 4/1943 Walton ..... 72/57
2,783,727 * 3/1957 Hoffmann ..... 72/57
5,819,572 10/1998 Krajewski ..... 72/42
5,974,847 11/1999 Saunders et al. ..... 72/57

* cited by examiner

*Primary Examiner*—David Jones
(74) *Attorney, Agent, or Firm*—George A. Grove; Jeffrey A. Sedlar

(57) ABSTRACT

Superplastic forming equipment and processes featuring a rotatable, low-friction stuffing unit for engagement with a blank sheet of superplastic formable metal to optimize the quantity or amount of material that is drawn onto a forming die for improved part forming. The stuffer is rotatably mounted in a chambered upper tool of the forming equipment and is offset from the forming profile of the lower forming die. The rotatable stuffer physically contacts portions of a blank sheet of heated forming material as the upper tool is lowered and effectively pulls the sheet material into the working area and around portions of the profile of the forming die in an intermediate or preforming phase of forming operation. With increased material in operative position in the die, the wall of the formed part will be intact and meet design specifications.

6 Claims, 3 Drawing Sheets

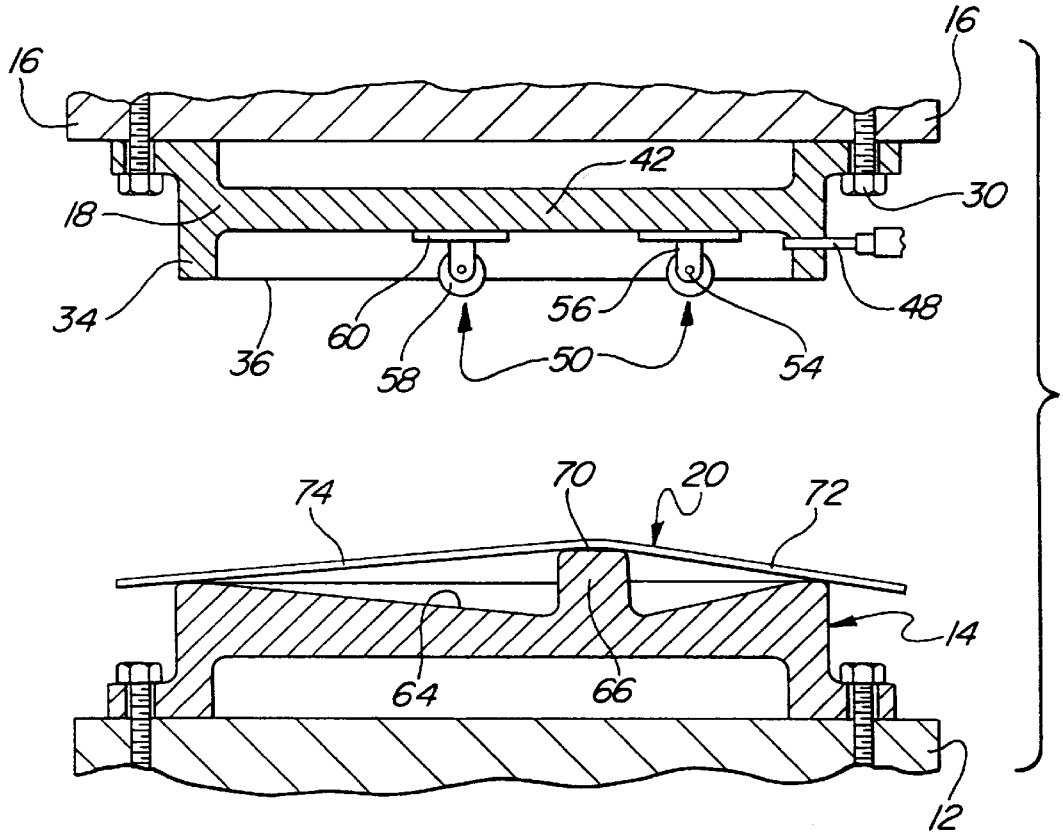
FIG-2
FIG-3
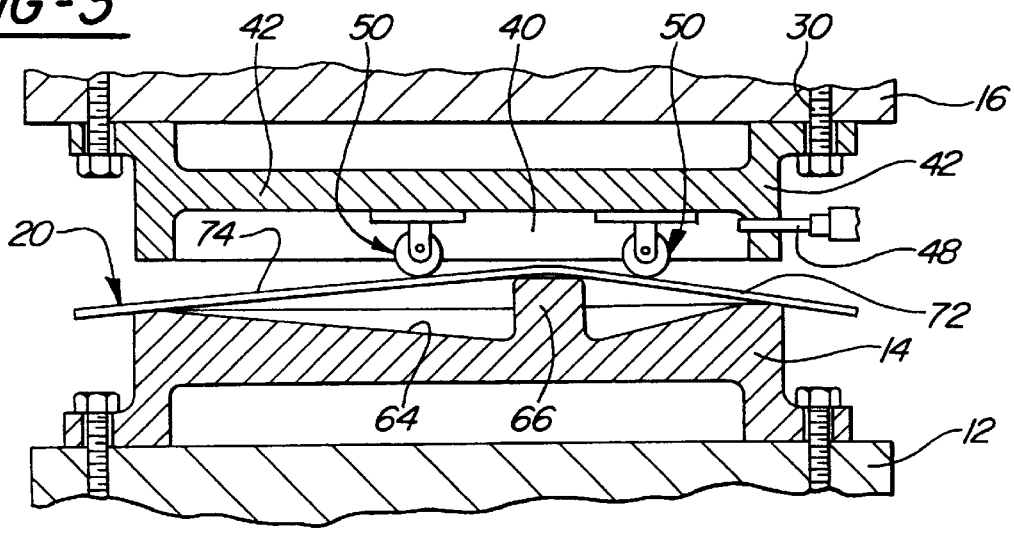

ROTATABLE STUFFING DEVICE FOR SUPERPLASTIC FORMING AND METHOD

TECHNICAL FIELD

This invention relates to the art of superplastically forming heated metal sheet material into profiled parts and more particularly to new and improved superplastic forming equipment and processes featuring advanced construction and processes for mechanically stuffing the heated sheet material into an optimized preform position with respect to a forming profile of the equipment during a superplastic forming cycle.

BACKGROUND OF THE INVENTION

Prior to the present invention, various constructions and methods have been devised to improve the operations of superplastic and quick plastic forming equipment in the forming of high quality parts from sheets of aluminum alloy or other superplastic metal alloys. For example, in U.S. Pat. No. 5,974,847 issued Nov. 2, 1999 to Sanders et al for Superplastic Forming Process, assigned to the assignee of this invention and hereby incorporated by reference, a heated sheet of superplastic forming metal alloy is positioned on a preforming block mounted on a lower die platen. A forming die is then lowered into a preforming position in which the peripheral lower edges thereof surround the block thereof and contact the outer edge portions of the heated sheet. These lower edges in conjunction with the preform block act as stuffer unit to pull the material inwardly into an intermediate or preform position as the forming die reaches its closed or seated position. With the heated sheet in the preform or intermediate position in which more sheet material has been pulled into a preform, low pressure inert gas is injected into the interface between the preformed sheet and the preform block to stretch the sheet material into the desired shape as defined by the profile of the forming die. After part forming, the die can be opened so that the part can solidify and be handled and removed without damage thereto.

SUMMARY OF THE INVENTION

While such existing stuffing devices are simple static devices that effect mechanical deformation of the metal sheet material and that effectively gathers more sheet material into the die set, high friction forces between the stuffer and sheet material may cause the physical tearing of the material as the forming dies are closed. Such material tearing results in part defects and limits the amount of material that can be stuffed into the die set. With limited amounts of material that can be drawn into the die set, there may be insufficient material to make an optimized part. More particularly, there may be insufficient material for optimizing shapes and the wall thickness, and the part may have tears or voids resulting in part rejection. Such tearing or flaws reduce the production effectiveness and efficiency of the equipment.

Accordingly, a gentle or cushioned low-friction material contact or stuffing unit is needed for optimizing the engagement between the contact and the sheet to optimize the quantity of material that is drawn into the forming die for improved part forming.

These problems and requirements have been worked out in the present invention by providing a stuffer having a freedom of rotation to effectively reduce the friction between the stuffer and the superplastic forming blank and to provide a better material distribution in the formed part. The reduced friction allows for improved intermediate deformation of the blank sheet of superplastic forming material into an optimized preform with more material pulled into the die set. This ensures that there will be minimized thinning or tearing and resultant part rejection when the equipment is operated to superplastically form a part.

In the preferred embodiment of this invention, at least one rotatable stuffer is mounted in a chambered upper tool of the superplastic forming equipment which is offset from the forming profile of the lower steel or forming die. This ensures that the profile of the forming die and stuffer do not physically contact one another in the stuffing or intermediate forming operation. The rotatable stuffer, however, physically contacts portions of a blank sheet of superplastic forming material as the upper tool is lowered and, with low rolling resistance or friction therebetween, effectively pulls the sheet material into the working area and around portions of the profile of the forming die equipment in the intermediate phase of forming operation. With the sheet intact and pulled into an optimized preform position around the forming die, sufficient material is present within the working chamber so that the part can be fully formed without wall thinning or tearing when the chamber is charged with pressure gas. The rotating contact of the stuffer importantly results in reduced friction between the stuffer and the blank sheet. The reduced friction allows more deformation of the forming blank and therefore more material in the die set.

BRIEF DESCRIPTION OF THE DRAWINGS

These and other features objects and advantages of the present invention will be more apparent from the following detailed description and drawing in which:

FIG. 2 is a cross-sectional view of the superplastic forming equipment of FIG. 1 shown in open position;

FIG. 3 is another cross-sectional view similar to the view in FIG. 2 showing the components of the superplastic forming equipment moved toward a closed position showing initial contact of the stuffing components with the sheet to be superplastically deformed;

DESCRIPTION OF THE PREFERRED EMBODIMENT

Figure 1:
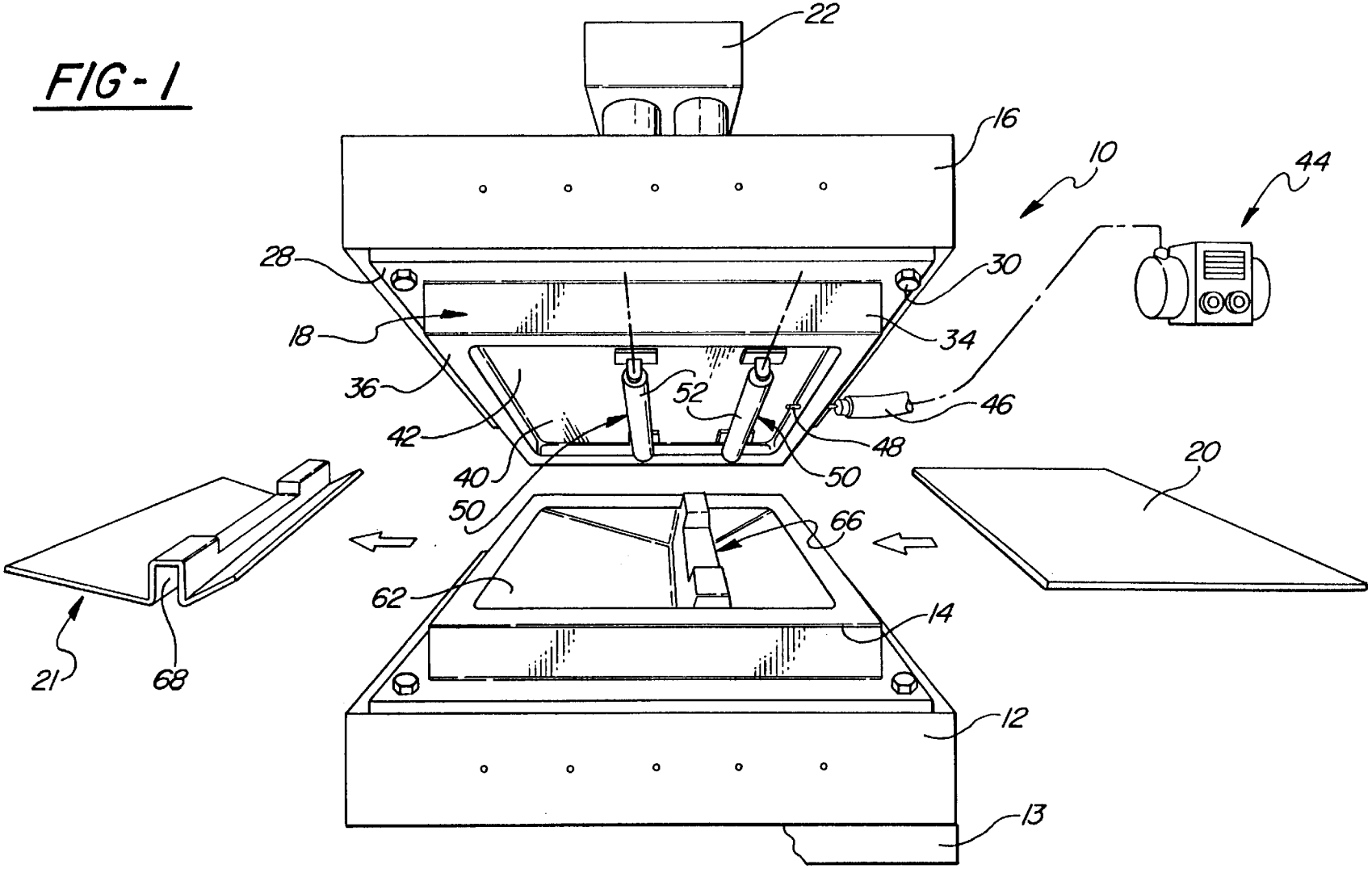
FIG. 1 is a pictorial view of superplastic forming equipment operatively mounted in an associated press for forming sheet material into a profiled part.

Turning now in detail to the drawing, FIG. 1 pictorially illustrates portions of a press 10 comprising a stationary bolster plate 12 mounted on a fixed support 13. The bolster plate in turn operatively mounts lower tool steel or forming die 14 that extends upwardly from the upper surface thereof. The press additionally has an upper reciprocating ram plate 16 that carries a chambered upper tool 18 which generally corresponds to the upper tool of U.S. Pat. No. 5,819,572 issued Oct. 13, 1998 to Krajewski for Lubrication System For Hot Forming, assigned to the assignee of this invention and hereby incorporated by reference. Both of the plates 12 and 16 are preferably electrically heated to bring the forming die equipment and a flattened blank sheet 20 of superplastic metal material used in forming shaped parts 21 to the heat energy levels needed for superplastic forming when properly placed in the tools as is known in this art.

The ram plate 16 is operatively connected by a wrist pin to a motor-driven eccentric or other suitable actuator diagrammatically illustrated at 22 so the upper tool 18 can be cycled between the open and closed operating positions with respect to the lower tool 14. The blank sheets 20 utilized with one preferred embodiment of the invention are flattened sheets of aluminum alloy coated with a dry lubricant such as boron nitride to function as a release agent to prevent the formed part or panel 21 from adhering to the forming die and to enhance the stretching and formation of the part during forming operation.

The upper tool 18 has a peripheral flange 28 having holes therein that receive fasteners 30 that operatively secure the upper tool to the lower face of the ram plate 16. Tool 18 also has a downwardly extending and generally rectilinear peripheral wall 34 whose lower face 36 provides a continuous face seal which sealingly engages the upper surface of the metal sheet 20 to define an air chamber 40 when the upper tool is in the closed position for part forming (see FIGS. 4 and 5).

The upper extent of air chamber 40 is provided by a solid and transversely extending upper wall or web 42 connecting the peripheral wall 34 of the upper tool. Chamber 40 is selectively charged with low-pressure air or other inert gas supplied thereto from a gas supply and controls 44 pneumatically connected thereto by line 46. FIG. 1 best shows line 46 connected to the chamber 40 by a passage or conduit 48 that extends through the sidewall 34 of the upper tool. The controls 44 are actuated to feed and exhaust pressurized gas with respect to the chamber 40 for superplastic forming operation after the press has effected die closure.

The upper wall 42 carries a pair of laterally-spaced stuffer units 50 parallel to one another. The stuffer units are mechanical assist devices for physically contacting the sheet of the forming material that gathers and pulls the material into the forming die to a degree much larger than prior art construction such as that of the above-referenced U.S. Pat. No. 5,974,847 to Saunders et al or by typical gravity wrapping that is often used in related processes and equipment. The stuffer units are offset from the forming profiles so that there is no interference therebetween when the dies are moved to a closed position for part forming. In the preferred embodiment of this invention, each stuffer unit comprises an elongated cylindrical contact or stuffer roller 52 of steel rotatably mounted by pivot pins 54 for turning movement about their respective rotational axes "a". The pivot pins extend axially from the end of the cylindrical contacts and are rotatably received in brass bushings in upstanding brackets 58 that have base plates 60 suitably secured to the upper wall such as by threaded fasteners 62.

The lower steel forming die 14 is generally concave to present an upwardly facing forming surface 64 to contour or shape the part 21 into the designed configuration. More particularly, the forming die may have positively extending profiling portions projecting upwardly from the concave surface thereof to form pockets, grooves or other configurations in the formed part for design purposes. For example, the lower die may be provided with a profiling insert or an integral profiling bar such as profiling bar 66 that extends across the forming surface of the die to form a recessed portion 68 to accommodate an accessory such as a marker lamp and escutcheon.

The upper surface 70 of the profiling bar provides an elevated mid support for the flattened blank sheet 20 which, because of its increasing heat energy levels gained from the heated press, reaches a temperature to have sufficient plasticity to drape or position itself to define left and right side portions 72 and 74 oppositely pitched with respect to one another. This is illustrated in FIG. 2, which shows the flattened sheet after being loaded and heated on the forming die and the effect of gravity on the sheet that becomes plastic when its heat energy level increases to an elevated temperature from the superplastic forming press. The opposite sides of the sheet may bend such as illustrated at the edges of the elevated profile and then turn downwardly in opposite directions until opposite side edges contact and are supported by the peripheral edges of the lower tool.

Figure 3A:
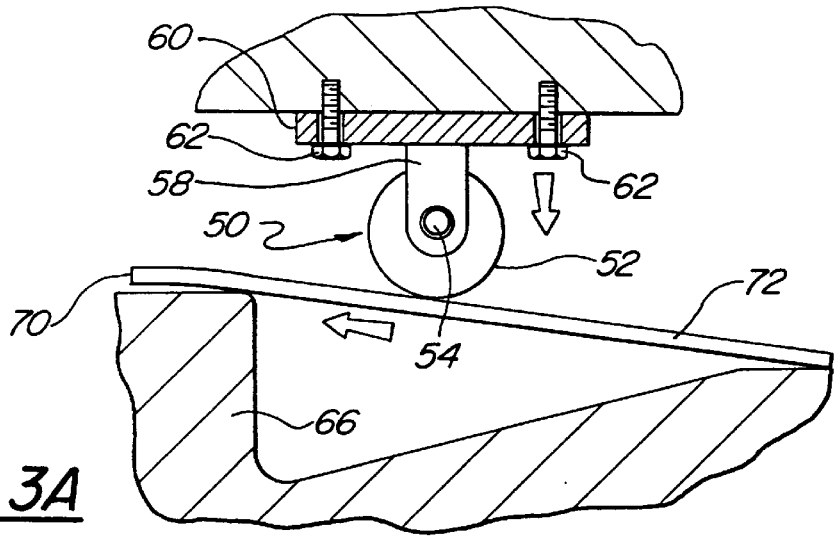
FIG. 3*a* is an enlarged portion of FIG. 3.

FIGS. 3 and 3*a* illustrate the initial contact of the low-friction stuffing rollers 52 with the upper surface of the left and right sides 72 and 74 of the sheet. As the upper tool 18 moves downwardly, the rollers 52 push downwardly on opposite sides of the sheet while turning with low resistance or friction. Because of the opposing pitch of the sides of the part, the downwardly force exerted on the sides through the rollers are off center from their rotational axes. The resultant frictional forces on the cylindrical contacts will be clockwise and counterclockwise, respectively, so that the rollers turn in the opposite directions. As the tool moves further downwardly to the FIG. 4 position, the material of the sheet will be pulled inwardly from opposite sides thereof as indicated by pull arrows P, P. This occurs as the portions of the sheet between the stuffing rollers and the upper edges of the profiling die are physically forced into the cavity of the lower tool and are forced into positions adjacent to the vertical side walls of the profiling bar.

Figure 4:
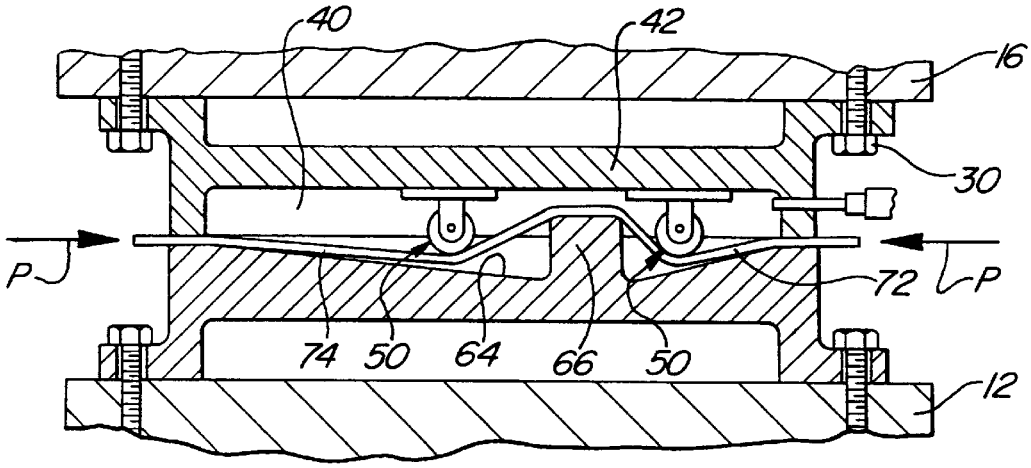
FIG. 4 is a cross-sectional view showing the mechanical stuffing of the sheet with respect to the profile of the equipment.
Figure 5:
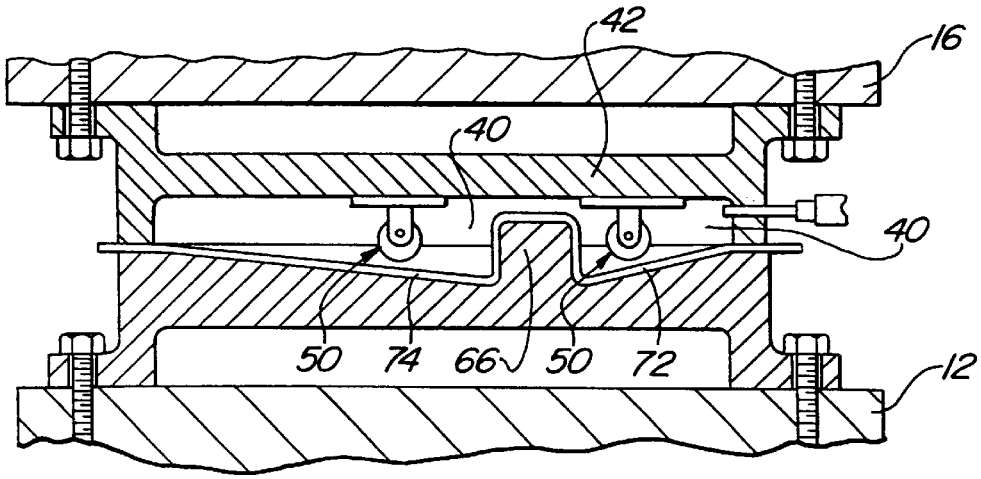
FIG. 5 is yet another cross-sectional view of the forming equipment superplastically forming the part.

FIG. 4 shows the cross-sectional shape of the sheet when the upper and lower dies are in a closed position fully mechanically preformed by the rollers and the forming bar. Subsequently, low-pressure air or other inert gas is fed into pressure chamber 40 to force the sheet downwardly from the rollers and onto the forming surface 64 of the lower die 14 and into close engagement with the forming bar as shown in FIG. 5.

Accordingly, with increased material pulled into the die, there is sufficient material to make the part and importantly to make the part without tears or stuffing-induced defects and which meets specifications such as wall thickness. While the co-friction cylindrical stuffing units are shown as being substantially identical, their diameters can be different and the rollers have different configurations, such as conical configurations or other desired shapes, to meet particular requirements.

While some preferred methods and mechanisms have been disclosed to illustrate the invention, other methods and mechanisms embracing the invention can now be adapted by those skilled in the art. Accordingly, the scope of the invention is limited by the following claims drawn to this invention.

What is claimed is:

1. A method of plastically forming sheets of metal alloy into shaped parts using superplastic forming equipment including a pair of primary forming components operatively mounted upper and lower bolster plates of a press for relative movement between an open position for sheet loading and formed part unloading and a closed position for forming said sheet into a shaped part, one of said primary forming components having a forming cavity therein and a discrete forming profile extending upwardly therefrom and toward the other of said primary components, said last mentioned primary component having at least one rotatable stuffing unit projecting toward and offset from said discrete forming profile comprising the steps of mounting a sheet of metal alloy on the upper surface of said profiling member of the first component, relatively moving the components toward one another, physically engaging the sheet with the rotational component to stuff the sheet generally around the profiling die and charging one of said components with a pressurized gas to apply a force to the upper surface of the sheet to finish forming the sheet to the shape dictated by the profile of the profiling die.

2. A method of superplastic forming of flattened metal sheets into shaped parts comprising the steps of: inserting the sheet onto a forming block extending upward from the upper surface of a concave forming die, heating the flattened sheet so that it drapes on the forming block, moving an upper die into a blank pre-form position and mechanically pre-forming the sheet by physically contacting and pulling the sheet inwardly with a roller stuffing member adjacent to the forming block, and pressurizing the upper chamber to fully form the sheet onto the surface of the forming chamber and the forming block to effect the final shaping of the part, opening the upper die with respect to the lower die and removing the shaped part from the die.

3. Equipment for superplastic forming of a sheet of metal into profiled parts comprising a forming die member, said forming die member having a concave shaping surface with a profiling unit that projects upwardly therefrom, a complementary gas chamber member that provides a chamber selectively pressurized with a working gas therein, said gas chamber having a rotatable blank stuffing member fixed therein, said rolling blank-stuffing member being offset from the profiling unit and which projects into the gas chamber, said blank-stuffing rolling member being adapted to contact said blank and mechanically draw said sheet inwardly to a preliminary preform position on said profiling unit, control mechanism for pressurizing said chamber so that said pressure can subsequently form said blank around said profiling unit to effect and complete formation of said part.

4. Superplastic forming dies including upper and lower relative movable die members, said lower die member having a concave forming surface therein and an upstanding profiling unit extending at least partly across a portion of the lower forming surface, said forming surface having an upward support surface for supporting a flattened sheet of metal plastic forming material at points between the side edges thereof, said lower die having a peripheral edge supporting said side edges of said sheet, said upper die member having a stuffing unit extending downwardly therefrom, said stuffing unit comprising a rotatable member for low-friction rolling contact with the sheet for mechanically forming the sheet into a preform, and pneumatic construction for subsequently further deforming the sheet into a fully formed part.

5. The construction of claim 4 in which the stuffing unit is a cylindrical roller offset from the profiling unit.

6. The construction of claim 4 wherein said stuffing unit comprises a pair of cylindrical rollers laterally offset from one another to embrace the lower profiling unit when the dies are closed.

* * * * *